United States Patent [19]

Bass et al.

[11] 4,440,058

[45] Apr. 3, 1984

[54] DIGITAL TONE GENERATION SYSTEM WITH SLOT WEIGHTING OF FIXED WIDTH WINDOW FUNCTIONS

[75] Inventors: Steven C. Bass, Stockwell; Thomas W. Goeddel, West Lafayette, both of Ind.

[73] Assignee: Kimball International, Inc., Jasper, Ind.

[21] Appl. No.: 500,552

[22] Filed: Jun. 2, 1983

Related U.S. Application Data

[63] Continuation of Ser. No. 369,976, Apr. 19, 1982, abandoned.

[51] Int. Cl.[3] ..... G10H 1/02

[52] U.S. Cl. ..... 84/1.26; 84/1.19; 84/1.01; 84/1.13; 84/1.25

[58] Field of Search ..... 84/1.01, 1.03, 1.19, 84/1.21, 1.22, 1.26, 1.23, 1.24, 1.25

[56] References Cited

U.S. PATENT DOCUMENTS

| | | | |
|---|---|---|---|
| 3,809,786 | 5/1974 | Deutsch | 84/1.01 |
| 4,079,650 | 3/1978 | Deutsch et al. | 84/1.26 |
| 4,108,036 | 8/1978 | Slaymaker | 84/1.26 |
| 4,133,242 | 1/1979 | Nagai et al. | 84/1.26 |
| 4,265,157 | 5/1981 | Fricke et al. | 84/1.19 |
| 4,282,790 | 8/1981 | Wachi | 84/1.21 |
| 4,351,219 | 9/1982 | Bass | 84/1.21 |
| 4,373,416 | 2/1983 | Endo et al. | 84/1.01 |

OTHER PUBLICATIONS

"Signal Processing Aspects of Computer Music: A Survey", by James Anderson Moorer, *Proceedings of the IEEE, vol. 65, No. 8,* Aug. 1977, 1108–1137.

"On the Use of Windows for Harmonic Analysis with the Discrete Fourier Transform", by Fredric J. Harris, *Proceedings of the IEEE, vol. 66, No. 1,* Jan. 1978, pp. 51–83.

"Music Synthesis Using Real Time Digital Techniques", by Harold G. Alles, *Proceedings of the IEEE, vol. 68, No. 4,* Apr. 1980, pp. 436–449.

*Primary Examiner*—Forsester W. Isen

*Attorney, Agent, or Firm*—Jeffers, Irish & Hoffman

[57] ABSTRACT

An electronic musical instrument wherein purely digital techniques are utilized for generating the basic waveform train and also keying the waveform train so as to have the customary keying envelope with attack, sustain and decay portions. The wavetrain is a cyclically repeated series of four-term Blackman-Harris window functions, wherein there are preferably eight such functions in each series. A plurality of individual keying envelopes are generated by a piecewise linear technique, and these envelopes are assigned respectively to the waveforms in the series so that the relative amplitudes of the waveforms can change with time over the life of the tone. This results in modulating with time the harmonic content of the tone.

46 Claims, 18 Drawing Figures

SIGN BIT
170
146
142
144
C
0
1
MUX
ADDRESS
ROM
148
4' (180°)
172
166
152
150
COMPARATOR
IN ≤ 8?
164
162
160
156
154
1/2
138
158
110
15 BIT
PERIOD
ADDRESS
1
118
116
114
112
128
122
MUX
120
126
124
DELAY
130
ADDRESS
ROM
OUT
132
136
4' (0°)
140
134
COMPARATOR
IN ≤ 8?

DIGITAL TONE GENERATION SYSTEM WITH SLOT WEIGHTING OF FIXED WIDTH WINDOW FUNCTIONS

BACKGROUND OF THE INVENTION

This is a continuation of application Ser. No. 369,976, filed Apr. 19, 1982, now abandoned.

The present invention relates to an electronic musical instrument, and in particular to a substractive synthesis technique wherein separate envelopes are applied to the individual waveforms, such as window functions, in a cyclically recurring series of a finite number of such waveforms.

The present invention is concerned with a further development to the digital tone generation system disclosed in copending application Ser. No. 190,631, filed Sept. 25, 1980, and entitled Digital Tone Generation System Utilizing Fixed Duration Time Functions, which application is expressly incorporated herein by reference.

Electronic real-time music is performed on two basic types of instruments: digital synthesizers and electronic organs. Synthesizers typically employ highly complex mathematical algorithms, and with the exception of laboratory research installations, they are capable of the simultaneous sounding of only a small number of distinct voices. Such instruments are limited when played by skilled keyboard musicians who may depress as many as twelve keys at one time. Furthermore, these instruments are often based on additive or frequency modulation synthesis techniques, and their cost is sufficiently high that the market for them is quite limited.

More reasonably priced electronic musical instruments are electronic organs, which have increasingly employed digital techniques in recent years, and are intended for home, church or theater use. Since even lower priced electronic organs may have the capability of producing as many as thirty voices, a large percentage of which may be simultaneously selected and sounded, a number of variations of the technique of subtractive synthesis have been utilized for tone production.

In subtractive synthesis, there is first generated a periodic, harmonically rich waveform representing a particular footage of a desired fundamental frequency, which frequency is generally dictated by the key or pedal of the organ which is actuated. For example, A above middle C is approximately 440 Hz for an eight foot voice, and the two foot version of that would be four times the frequency, or 1760 Hz. If the harmonically rich waveform happens to be a square wave, which was the most commonly selected choice for many years, then the four, eight and sixteen foot versions of the fundamental two foot signal can be obtained with simple dividers.

The purpose of developing a plurality of footages of a desired fundamental is to form a linear combination of these footages in order to achieve harmonic emphasis. For example, the two foot, four foot and eight foot tones can be combined in a particular fashion and with a certain weighting of each component to form a staircase waveform, which is harmonically rich and used quite frequently in the tone generation sections of electronic organs.

The third stage of subtractive synthesis is the voicing or formant filtering operation, which produces different voices that emulate the pipes of an organ or other instruments.

Since many natural instruments exhibit formants (resonances) in their sounds, the inclusion of a voicing filter is necessary in most cases so that certain harmonics can be emphasized or deemphasized to produce the desired voice. For example, a certain hypothetical musical instrument might emphasize the harmonics in such a way so that its amplitude vs. frequency response exhibits two distinct peaks (formants), thereby indicating two frequency ranges over which harmonics receive significant amplitude emphasis. Other Fourier components are relatively de-emphasized, and the existence and location of such formant peaks contributes heavily to the character or timbre of a musical voice. In this case, it is important to note that this amplitude emphasis of harmonics is without regard to the harmonic numbers, in that whether or not a particular harmonic receives a boost in amplitude depends only on the frequency range in which it lies. This is the type of behavior which would be expected from a natural instrument that exhibits various resonances determined by its particular mechanical construction. Thus, this mode of emphasis is to be distinguished from the harmonic number based emphasis that results from footage mixing.

As discussed in the aforementioned application Ser. No. 190,631, square waves have often been utilized for tone generation in electronic musical instruments because of their rich overtone content. The drawback to square waves in discrete-time implementation, such as in digital tone generation, is that of aliasing. In such implementations, a stored waveform is sampled in a repetitive fashion to produce the output tone, but the fundamental and all harmonics produce mirrored tones on both sides of the Nyquist frequency, which is one-half the sampling rate. In the case where the upper harmonics of the waveform are relatively high in amplitude, such as in a square wave, the folded overtones fall back within the range of human hearing and appear as noise or other objectionable sounds. In order to suppress objectionable aliasing, a very high sampling rate is necessary, but present day hardware for such sampling rates is not economically feasible.

The digital tone generation system of application Ser. No. 190,631 overcomes this problem of aliasing by utilizing the four term Blackman-Harris window function, which has negligible side lobes and thus greatly attenuated higher harmonics. The window function waveform is stored in a digital memory and read out at a fixed rate, but the time periods between successive readings of the waveform are varied to thereby vary the frequency of the output signal.

SUMMARY OF THE INVENTION

The present invention is concerned with the second step in subtractive synthesis, which is the production of harmonic weighting to achieve a particular harmonic structure. The invention employs a tone generator generally of the type disclosed in said prior application Ser. No. 190,631 which comprises a memory in which is stored one cycle of a waveform, such as the four term Blackman-Harris window function, and this waveform is read out at a fixed rate regardless of which key of the keyboard is actuated, and the periods of time between successive readings is adjusted depending upon the frequency of the tone to which the actuated key corresponds. The four term Blackman-Harris window function is defined as follows:

$$w(t) \triangleq \begin{cases} 0.35875 + 0.48829\cos(2\pi t/T) \\ +0.14128\cos(4\pi t/T) \\ +0.1168\cos(6\pi t/T), \\ \text{for } |t| \leqq T/2 \\ 0, \text{ elsewhere} \end{cases}$$

A drawback to many electronic organs is that their emulations of pipe organs or other instruments is not completely realistic because of the limited amount of time-varying timbrel quality. In other words, the inability to change a note's timbre throughout its life caused by depressing the key makes the resulting tone sound unnatural.

In the present invention, the harmonic content of the tone can be varied with time over the general keying envelope for the tone by generating a plurality of keying envelopes, each having attack, sustain and decay portions, and each scaling an individual waveform in the cyclically recurring series of such waveforms that makes up the sixteen foot signal. In the particular embodiment disclosed, eight such waveforms make up the series, and eight independently generated keying envelopes are applied to the respective waveforms so that their amplitudes vary with time, thereby enabling time modulation of harmonic content. In a preferred form of the invention, the keying envelopes are generated in piecewise linear fashion by reading out from a memory increment and destination values for each of the thirty-two segments making up each of the eight envelopes. Preferably, the envelopes are generated in time shared fashion so that the entire operation of the tone generation system for that particular voice can be accomplished by a single circuit.

Tremolo can be achieved by incorporating its undulations into these piecewise linear waveforms. The adjacent segments in the sustain portions of these envelopes have slopes of opposite sign. Tremolo depth is adjusted by increasing or decreasing the increment values associated with these segments. Similarly a tone's decay time duration can be adjusted by changing the increment values of certain segments in the latter portions of these envelopes.

More specifically, the present invention is concerned with an electronic musical instrument having a player operated tone selection means including a keyboard with playing keys for selecting a tone to be played by the instrument, and a tone generator responsive to the tone selection means comprising a memory in which one cycle of a waveform is stored, and means for selectively reading the stored waveform out of the memory and at a fixed rate but wherein the period of time between successive readings is selectively adjusted depending upon the frequency selected by the tone selection means to thereby produce a train of the waveforms comprising a plurality of cyclically recurring series, each series having a predetermined number of the waveforms therein. The invention includes an envelope generator responsive to the actuation of a key of the keyboard for generating a plurality of time varying amplitude envelopes assigned, respectively, to the waveforms in the series, and keying means for scaling the amplitude of each waveform in the series by its respective envelope.

In a preferred embodiment of the invention, the envelope generator is responsive to the actuation of the key of the keyboard for generating a plurality of time varying piecewise linear amplitude envelopes each comprising a plurality of connected linear segments with each segment having a destination amplitude and a constant slope between its destination amplitude and the destination amplitude of the previous segment of that envelope and each including attack, sustain and decay portions each comprising diverse ones of the segments. The envelopes are assigned, respectively, to the waveforms in the series, and keying means responsive to the waveform train and to the piecewise linear envelopes scale each waveform by the envelope assigned to it thereby enabling selective varying of the amplitudes of the individual waveforms in the series independently of each other from segment to segment of the piecewise linear envelope assigned thereto so as to vary with time the harmonic content of the waveform train.

The invention also relates to a method of generating a musical tone comprising providing a memory in which a representation of one cycle of a waveform is stored, addressing the memory to read out the stored representation of the waveform always at a fixed rate and repetitively but selectively adjusting the period of time between successive readings to select the frequency desired so as to produce a series of a predetermined number of the read out waveforms, the series being cyclically repeated, and wherein the waveforms are separated from each other by said period of time. A time varying amplitude envelope having generally an attack portion, a sustain portion and a decay portion is generated, and the cyclically repeated series of waveforms are keyed by the amplitude envelope in such a manner that the amplitudes of the waveforms in the series are varied independently of each other while the amplitude envelope is being generated wherein the relative applitude levels of at least some of the individual waveforms with respect to each other change for different portions of the envelope. The envelope is comprised of a plurality of components assigned, respectively, to the waveforms in the series thereby enabling the independent scaling of the individual waveforms

DETAILED DESCRIPTION

Figure 1:
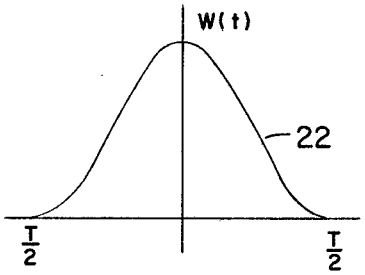
FIG. 1 is a frequency domain plot of the four-term Blackman-Harris window function.

FIG. 1 is a frequency domain plot of the four-term Blackman-Harris window function given by the formula disclosed earlier. As discussed in prior application Ser. No. 190,631, in prior art digital tone generation systems, the stored waveform is generally scanned or addressed in a cyclic fashion wherein the rate of scanning or addressing is increased for the production of higher frequency tones and decreased for the production of lower frequency tones. Thus, the time duration of each individual waveform period decreases with increasing frequency caused by a higher rate of scanning, and there are more such individual waveforms prior unit length of time due to the fact that there is no zero level signal time or "dead space" between the individual waveforms. If the periodic signal generated from the window function prototypes were generated in the same way, it would simply be a matter of tracing window function pulses at a slow rate for lower frequencies and at a higher rate for higher frequencies so that each individual pulse occupies a shorter time interval. Producing higher frequency signals thus requires simply stepping through the memory, such as a read only memory table, with more coarsely spaced steps than would be used at a lower frequency.

Figure 2:
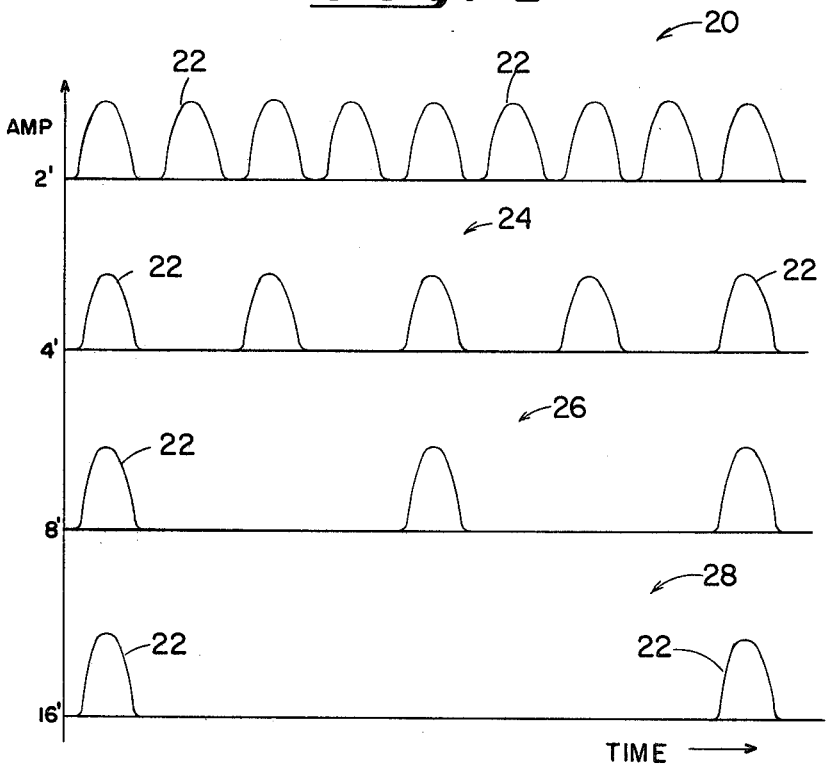
FIG. 2 is a time vs. amplitude plot of the two foot, four foot, eight foot and sixteen foot window function signals.

Prior application Ser. No. 190,631 teaches, however, that the frequency domain effect of constructing periodic signals in this way is undesirable because the center-lobe passband edge increases as the fundamental frequency increases, so that regardless of frequency, the periodic window signal always has the same number of harmonics. Moreover, the stopband or side-lobe region is pressed further out in frequency with increasing fundamental, and can extend beyond the chosen Nyquist frequency In order to eliminate this deficiency, it was noted that if the prototype waveform changes neither in shape nor in time duration, the envelope imposed on the spectral delta functions is unaffected by the choice of fundamental frequency. This is the technique taught by application Ser. No. 190,631 for the generation of octave frequencies such as disclosed in FIG. 2 wherein the window function pulse contained in each period maintains a fixed time scale regardless of frequency. Between each pulse is placed a time interval of zero signal level sufficiently long to make up the balance of the fundamental period desired. For example, the first line in FIG. 2 illustrates a sequence 20 of individual window function waveforms 22 that are generated at the two foot rate with very little spacing between them. To generate the four foot signal 24 also illustrated in FIG. 2, all that is necessary is to delete the alternate waveforms from the two foot wave train by generating a zero level signal between alternate waveforms 22. The eight foot wave train 26 is generated by deleting the alternate wave forms from the four foot wave train by again generating a zero level signal during these periods. The sixteen foot wave train is generated by deleting the alternate eight foot window function waveforms so that there is a maximum spacing between adjacent waveforms 22. Although the foregoing explanation refers to deleting waveforms, this is merely for the purpose of illustration and what would actually be done is to generate waveforms 22 only at the frequency which is desired. In any event, the individual waveforms 22 are always of the identical width and only the spacing or dead time between them is varied depending upon which key of the keyboard is depressed.

Figure 7:
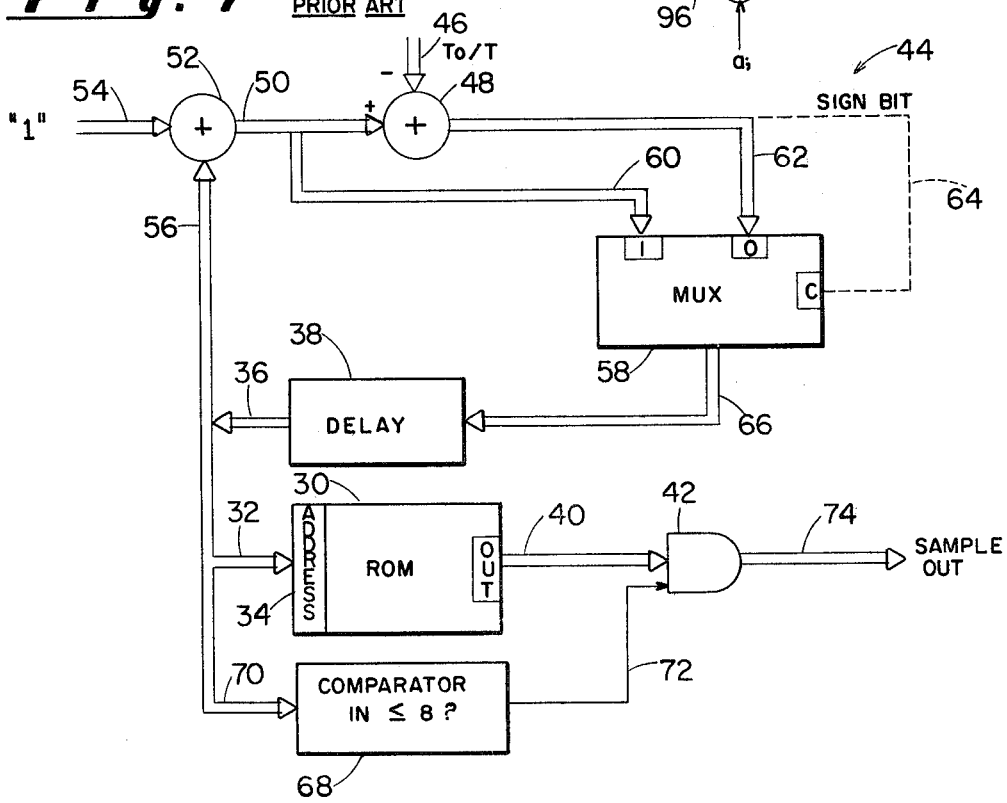
Fig. 7 PRIOR ART
FIG. 7 is a schematic diagram of a prior art oscillator for generating the periodic window function.

FIG. 7 illustrates an example of the hardware required to generate the periodic four-term Blackman-Harris window function signals A single cycle of the window function is stored in read only memory 30 and the input 32 to the address portion 34 of memory 30 is connected to the output 36 of delay circuit 38. The output 40 of read only memory 30 is connected to one of the inputs of AND gate 42.

The period of the desired signal, in units of $T=1/f_s$, (wherein $f_s$ is the sampling frequency) is the only input required by oscillator 4. This input on line 46 to subtractor 48 is equal to the period of a single window function (including dead time) divided by the period of a single sample time T, and this quantity equals the number of samples per window function waveform. As an example, the window function minus dead time may equal eight samples per waveform generated. The other input to subtractor 48 is the output 50 from adder 52, which has as one of its inputs 54 the integer value one, and as its other input 56 the output of delay circuit 38 in the feedback loop comprising adder 52, multiplexer 58 and delay circuit 38.

Subtractor 48 subtracts from a recirculating data stream that is being incremented by the integer one for each cycle through the feedback loop the number of samples for an entire single period. Multiplexer 58 has as its first input 60 the output from adder 52, which is the recirculated data stream being incremented by 1 each cycle, and as its second input 62 the output from subtractor 48, which is the difference between the number being recirculated and incremented in the feedback loop and the total number of sample times per period. When the control input 64 of multiplexer 58 detects a change in sign, which indicates that the entire period has been completely counted through, it no longer passes to its output 66 the incrementing count on the input 60, but instead, passes the output from subtractor 48, thereby permitting the counting sequence to be again initiated.

The input 32 to ROM 30 addresses a sequence of sample points within ROM 30 to produce on output 40 samples of the four-term Blackman-Harris window function. Since outputs are desired only during the time period for which the window function is to be produced, and since, in this particular case, the time period comprises eight samples, it is necessary to disable gate 42 at all times other than those during which the window function is to be sampled. This is accomplished by comparator 68 which has its input 70 connected to the output of the feedback loop, and its output 72 connected to AND gate 42. When the value on its input 70 is less than or equal to eight, comparator 68 enables AND gate 42, and at all other times disables AND gate 42. The output 74 from AND gate 42 carries the sampled four-term Blackman-Harris window function followed by a zero signal level of appropriate duration to select a particular frequency. The fundamental period $T_0$, expressed in units of the sample time T, is presented at input 46. A sixteen bit representation for this value is appropriate, wherein eleven bits represent the integer portion and five for the fractional.

Having discussed the technique of generating the basic waveform, which is preferably the four-term Blackman-Harris window function, the technique for accomplishing the harmonic emphasis portion of the subtractive synthesis technique will now be considered. Earlier electronic musical instruments weighted the various harmonics of the fundamental, usually without regard to its frequency value, by attenuating or emphasizing the strengths of the various harmonics. The emphasis performed was based strictly on harmonic number, rather than on harmonic frequency. Spectral emphasis that is based on the actual frequency locations of harmonics is performed by the voicing or formant filtering operation accomplished after the appropriate harmonic weighting has taken place.

Figure 4:
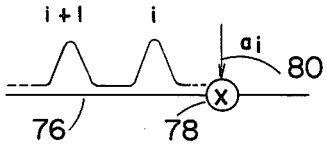
Fig. 4 PRIOR ART
FIG. 4 is a schematic of the weighting circuit.
Figure 3:
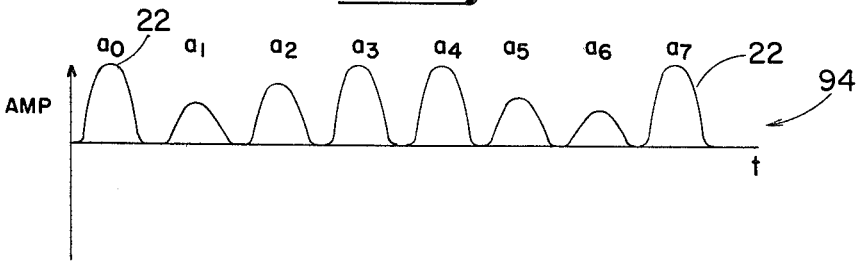
FIG. 3 is an amplitude vs. time plot of the eight window functions, independently weighted, of one complete series of the waveform train.
Figure 5:
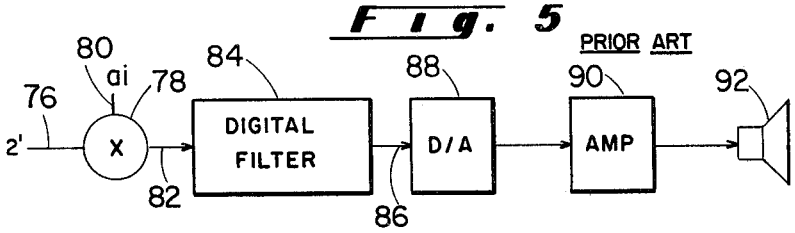
Fig. 5 PRIOR ART
FIG. 5 is a block diagram of the system used to independently weight the waveforms in the series of waveforms illustrated in FIG. 3.

Rather than simply adding together the various octavely related footages that have been selectively attenuated to produce the harmonic content, prior application Ser. No. 190,631 discloses a serial technique as disclosed in FIGS. 4 and 5. Assuming that there are eight waveforms 22 in a single series 94 of the sixteen foot periodic signal, such as illustrated in FIG. 3, and in the first line of FIG. 2, the latter being for the two foot signal, then it is possible to adjust harmonic content by independently adjusting the amplitudes of these individual waveforms. In FIG. 3, the waveforms 22 are denoted by their amplitude coefficients a0, a1, a2, a3, a4, a5, a6 and a7, and each of the waveforms are illustrated as having various amplitudes. As shown in FIG. 5, the input 76 to multiplier 78 is the two foot signal of the first line of FIG. 2 and the other input 80 is a series of coefficients ai to which values are selectively assigned, as by reading them from a read only memory. After the ith pulse passes through multiplier 78 and the (i+1)st waveform begins, the multiplier coefficient on input 80 is changed from ai to ai+1. Once coefficient a7 has operated on all the samples of the eighth waveform in the series illustrated in FIG. 3, the coefficient input 80 is cycled back to a0 and a new sixteen foot period of the signal, which is one series of eight waveforms 22, is begun. This weighted waveform series 94, such as that illustrated in FIG. 3, appears on line 82 at the input of digital filter 84. This signal on line 82 has the selected harmonic content, and the voice characteristics or timbre are then produced by filtering the signal in filter 84. This digital signal is then connected to the input 86 of digital to analog converter 88, which converts the signal to analog form, and is then amplified in amplifier 90 and connected to speaker 92.

It should be noted that the sixteen foot signal 94 on line 82 is in terms of eight digital samples for each waveform 22 in the series shown in FIG. 3. This series is repeated over and over again as long as the key is depressed so as to produce a continuous tone having the desired harmonic content. What has been accomplished is to trade a large number of computations in return for a series of individual computations plus the necessity to determine the end of one pulse in a succession and the beginning of the next. This can be done during the generation stage, or the generator's output sample stream can be monitored for the presence of one or more zero samples, which would indicate the necessity to advance to the next multiplier coefficient. The time regime associated with an ai coefficient will be referred to hereinafter as a "time slot".

As an example of the harmonic effects of slot weighting, the following ai coefficients can be selected:

| | |
|---|---|
| $a_0 = 1.0$ | $a_4 = 0.2$ |
| $a_1 = 0.2$ | $a_5 = 0.8$ |
| $a_2 = -0.8$ | $a_6 = 0.0$ |
| $a_3 = -0.6$ | $a_7 = -0.9$ |

Figure 6:
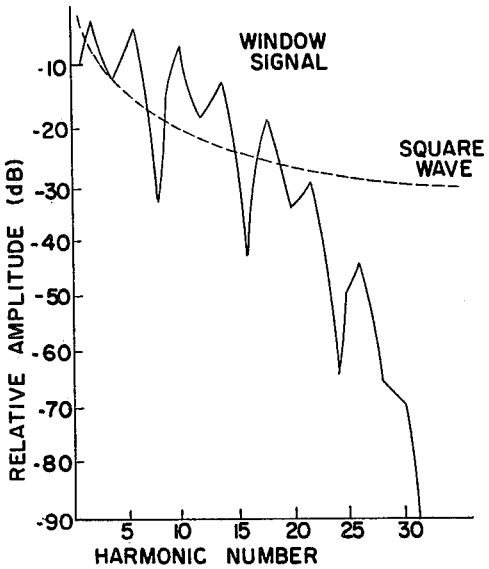
FIG. 6 is a diagram of the relative harmonic content of a is a diagram of the relative harmonic content of a sixteen foot voice with non-binary pulse slot weightings.

Using a four-term Blackman-Harris prototype and assuming fs=40 KHz and fo=625 Hz, the harmonic structure illustrated in FIG. 6 is obtained. In the same plot is illustrated the harmonic envelope for a 50% duty cycle square wave for comparison. An eight point periodicity of the harmonic weight riding on top of the window functions spectral centerlobe is evident.

Although there are many advantages to utilizing the fixed width window functions as the basic waveform, there are certain short-comings at higher frequencies. Since the window function waveform in each period of a two foot signal is of fixed time duration, there is a maximum frequency above which successive pulses will overlap in time. For example, using the four-term Blackman-Harris function with a sampling frequency of 40 KHz, and setting the center lobe edge at the Nyquist frequency yields a period of 200 microseconds. Thus, overlap in this case occurs beyond a two foot fundamental frequency of 5 KHz and on most organ keyboards, this will not quite cover the top octave of the upper manual. High C in that octave is possibly 8372 Hz, but even this is not likely to be enough and additional head room will be necessary for vibrato effects, for example.

Pulse overlap is a problem of implementation, and not a mathmatical one, and the theory regarding the spectral behavior of fixed duration pulse trains is uneffected by such overlap. However, slot weighting requires that successive slots be distinguished, and a convenient way of accomplishing this is to search for zero samples appearing in the interpulse dead time. But when pulse overlap appears, all dead time intervals are eliminated.

Figure 8:
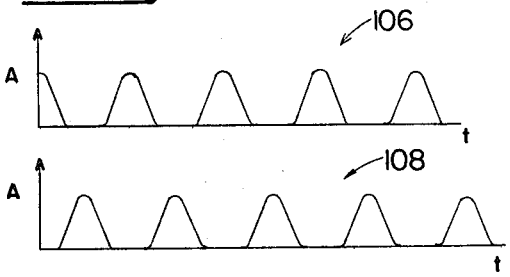
FIG. 8 is an amplitude vs. time plot of two four foot window function signals which are 180° out of phase with each other and result from the operation of the circuit shown in FIG. 9.
Figure 8A:
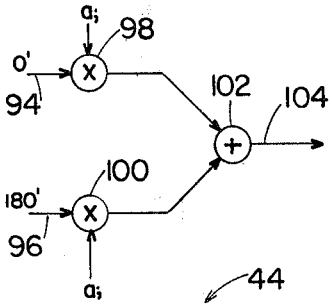
FIG. 8A is a schematic of the dual multiplier circuit.

FIG. 8A illustrates one technique for solving this problem, wherein rather than generating a two foot signal from one oscillator as in the top line of FIG. 2, two four foot signals as in the third line of FIG. 2 are generated by two osciallators 180° out-of-phase. The first four foot signal appears on line 94 from the first oscillator (FIG. 9) and the second four foot signal appears on line 96 from the second oscillator, which is running 180° out-of-phase with the first oscillator. The two signals are weighted by the ai coefficients in multipliers 98 and 100, and then these two signals are summed by adder 102 to produce the composite two foot signal on output 104. FIG. 8 illustrates the two waveforms 106 and 108 on lines 94 and 96, respectively.

Figure 9:
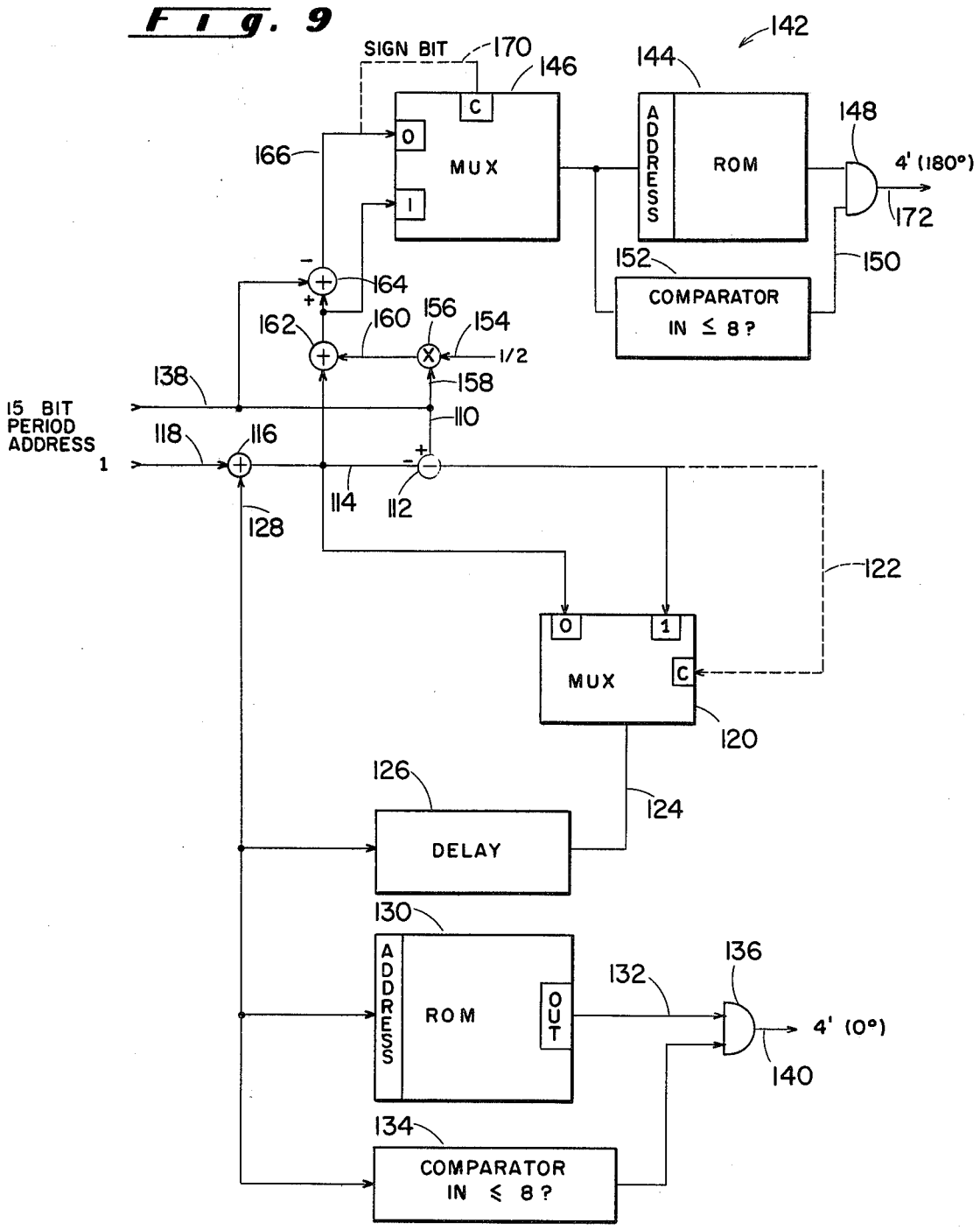
FIG. 9 is a schematic of the dual phase oscillator for generating the signals shown in FIG. 8.

FIG. 9 illustrates one possible dual phase oscillator, which is basically an interconnection of two oscillators similar to that illustrated in FIG. 7. As in FIG. 7, the fifteen bit period address is connected to one input 110 of subtractor 112 and its other input 114 is connected to the output of adder 116, which has one of its inputs 118 connected to a value of integer 1. Multiplexer 120 selects either the output of subtractor 12 or the output of adder 116 depending on the sign on control input 122. The output 124 of multiplexer 120 is delayed by delay circuit 126 in the feedback loop connected to the other input 128 of adder 116. Read only memory 130 is addressed by the recirculating incremented signal to produce on its output 132 eight samples of the window function. Comparator 134 compares the address for ROM 130 and when it exceeds eight, AND gate 136 is disabled. By selecting the address for the period on line 138 appropriately, a four foot periodic signal will be produced on the output 140 of AND gate 136.

The other half of dual phase osciallator 142 also comprises a read only memory 144 addressed by the output of multiplexer 146 and having its output connected to one of the inputs of AND gate 148, the other input 150 thereof being controlled by comparator 152 in the same way as comparator 134 controls AND gate 136. A value equal to one-half appears on input 154 of multiplier 156, and the other input 158 carries the period address. The output 160 of multiplier 156 is added to the recirculating incremented signal in adder 162, and this value is reduced by the period address in subtractor 164. Thus, subtractor 164 advances the recirculating signal by onehalf period so that the address appearing on input 166 of multiplexer 146 is shifted 180°. Multiplexer 146 selects input 166 until the sign on control input 170 changes, whereupon the output of subtracter 164 is selected. The net result is a four foot wavetrain appearing on the output 172 of AND gate 148 that is 180° out-of-phase with the output on line 140. Lines 172 and 140 are connected to the inputs 96 and 94 of the slot weighting circuit shown in FIG. 8A.

The generation of the keying envelope for the tone and the slot weighting of the respective waveforms in the series as functions of time will now be discussed. As mentioned earlier, the sixteen foot primary waveform comprises eight time slots, each slot containing a scaled version of a basic window function of fixed duration. Harmonic weighting is achieved by multiplying each time slot by its own weighting coefficient ai for the ith time slot. If the ai weighting coefficients are made functions of time, ai(t), then two advantages occur. The ai(t) coefficients can handle the keying function by varying in size to perform the attack, sustain and decay portions of the keying envelope which occurs when a note is depressed, held and then released, and secondly, during the lifetime of a note, the weighting functions for the respective waveforms in the series can vary with respect to each other to provide a time varying harmonic structure thereby greatly adding to the instrument emulation capabilities of the organ.

Piecewise linear functions have been selected to represent the amplitude envelopes for the individual waveforms for the series, not only because of their versatility, but also because they are easy to generate in digital hardware. Although piecewise linear functions have been utilized in the past to key notes, they will be used in this application to key the individual window functions in the series making up one period of the sixteen foot wavetrain. Thirty-two linear segments have been selected for each of the envelopes, and each segment may vary to have any slope and duration that is appropriate in view of the particular voice being generated. It is anticipated that a separate envelope generation circuit will be utilized for each individual voice, although a common dual phase generator can produce the basic waveforms for all voices of the instrument. Also, the envelope generation circuit for each voice can be time shared among a plurality of key channels, for example, sixteen channels, thereby enabling polyphonic operation. Since the output will always be in terms of digital samples of the amplitudes for the window function of the waveforms, time sharing the samples in this manner presents no problems.

Figure 10:
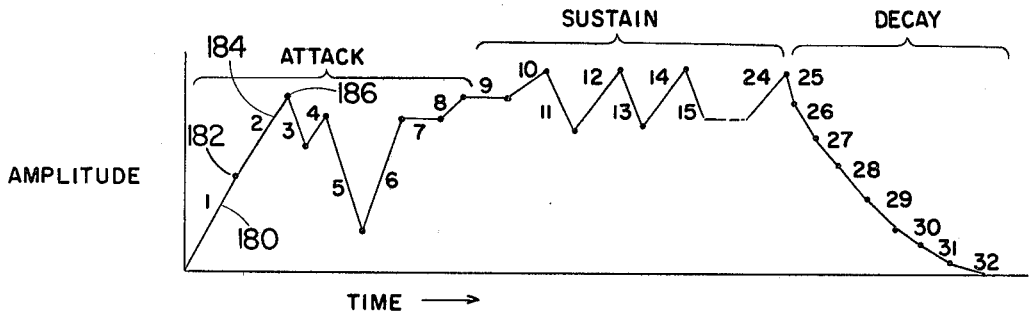
FIG. 10 is an amplitude vs. time plot of a typical piecewise linear amplitude envelope.

FIG. 10 illustrates an amplitude vs. time plot of a typical keying envelope for one of the waveforms in the series. The first eight segments have been selected as the attack portion of the envelope, the next sixteen segments as the sustain or steady state portion, and the last eight segments beginning with segment 25 as the decay portion. It should be noted that the amplitude envelopes assigned to the eight waveforms in the series will likely differ from each other, since each segment thereof is derived from an independent set of increment and destination pointers stored in a memory.

The preferred way of representing a segment in one of the amplitude envelopes is by specifying its increment and destination values. The increment, which is the amount of amplitude change per sample time, appropriate to the current segment is repeatedly added to an accumulator until the accumulator equals or exceeds the prescribed destination. At this time, the accumulator is replaced with the destination for that segment, and the increment and destination values appropriate for the next segment are produced until the next segment has been completely generated. Since each segment is a straight line, that is, a linear function from one amplitude level to the next, the overall shape of the envelope can be modified by changing the slope and destination of each segment. As will be noted in FIG. 10, the first segment 180 begins at zero and terminates at its destination point 182, and the second segment 184 begins at the destination point of the preceding segment 180 and ends at its destination value 186. This process continues throughout the generation of the thirty-two segments making up the amplitude envelope for that particular waveform in the series 94 (FIG. 3). FIG. 10 does not illustrate all of the segments in the sustain portion of the envelope, but they would likely alternate in a sawtooth fashion much like segments 10 through 15.

The shape of the envelope can be modified by modifying the slopes of the individual segments. For example, when making the transition from one amplitude point at the beginning of a segment to its destination, if the increments are larger in value, then the destination will be reached more quickly thereby resulting in a larger slope, either positive or negative. By the same token, if the increments are smaller, the slope will be less, resulting in a flatter segment because more time will be required to reach the next destination. It is assumed that the timing of the samples will be constant for all segments generated so that the variation in the increment values is what will modify the slope. Of course, a destination which is further removed from the beginning point of the segment will result in a longer segment, but it is the value of the increment which affects the slope.

A very wide dynamic range of possible increments and destinations will be required for the production of musical tones emulating a plurality of instruments. Furthermore, a fixed representation accuracy is not particularly desirable for these increments and destinations, but rather a fairly uniform percentage accuracy is preferred. Thus, the possible increment and destination values may have an exponential spacing in the same way the frequencies of a keyboard are spaced. In this case we will arange for two successive increments or destinations to be in the constant ratio of the fourth root of two, rather than the twelfth root of two, as is more customary. Thus, stepping up four units of increment corresponds to approximately a 6dB increase (doubling) of that increment. The same holds true in the case of destinations. Thus, if it is desired to effect a $1\frac{1}{2}$ dB increase in a note amplitude, for example, it would be necessary only to add one unit to the current increment and destination pointer values that refer to the range of increment and destination values themselves. The increment and destination pointer values must be distinguished from the range of increment and destination values themselves, the latter being actual changes in amplitude, whereas the former are utilized to drive a shift array, as will be described later.

For the preferred embodiment described herein, eight piecewise linear weighting functions must be generated by the slot weighting circuit for the eight waveforms of each series for each of the sixteen note channels representing the note playable by the instrument at any one time. The reason for sixteen notes is to accomodate keys which may have been released but the tones are still sustaining so that these notes will not be terminated prematurely if another key is depressed. Thus, there are 128 piecewise linear functions that must be generated, each with 32 segments, and all in time multiplexed fashion. Each of the channels is separated so that the even-numbered waveforms in the series of all channels arrive on one wire while all the odd-numbered waveforms of all the channels arrive on a second wire, and this primary note waveform data appears in bit-serial time-multiplexed form, which should not present a problem because of the fact that the data is in digital format. A single microprocessor control element oversees all of the slot weighting circuits, of which there will be one per voice.

The piecewise linear accumulators are updated with their current increments at such a rate as to allow two updates to occur during each period of the highest frequency sixteen foot waveform that can be generated. Since the highest two foot waveform frequency is probably 10 KHz, the highest sixteen foot waveform will be 1.25 Khz so that all of the 128 accumulators will be updated at 2.5 KHz, or once every 400 microseconds.

Each segment of each amplitude envelope will have associated with it not only the increment and destination pointer, but also a next segment number value, thereby enabling loops of segments to be generated indefinitely during the sustain portion of the envelope for tremolo and other effects. The increment pointers, destination pointers and next segment number values can be stored in a programmable read only memory, and this memory will be programmed such that the slot weighting circuit will be associated with a different voice. The slot weighting circuit itself bears no relationship to a particular voice, and it is only when the PROM is connected to it that it is associated with a voice. Thus, if a voice is to be changed or replaced, it is only necessary to reprogram the PROM, and no new custom circuitry needs to be developed.

The microprocessor controller will continually provide to the slot weighting circuits a serial bit train that indicates key-up or key-down information for each of the sixteen key channels maintained by the machine. Such microprocessor control is widely in use today for monitoring the state of the keyboards and then assigning controllable tone generators to keys which are depressed thereby bypassing the older technology of providing individual keyers for each pitch and voice that is to be produced.

An unused channel of a slot weighting circuit will reside continuously on segment number 32, the last segment in the decay portion. Since its accumulator value will have presumably long since reached zero, at each cycle of the slot weighting circuit, the increment appropriate to segment number 32 (for the key and time slot in question), will be added to the accumulator. The accumulator will have exceeded its destination value so that the destination value will replace the value in the accumulator, thereby causing the accumulator contents to remain at zero after the increment process. The next segment number for segment number 32 will always be 32, hence a free channel will be continuously stalled at segment number 32 on all of its time slots. When the key depression bit for this channel executes a transition, indicating that the microprocessor has assigned a new key to the channel, the next segment number for all slots of this key channel will be reset to zero, thereby restarting the piecewise linear generators for all time slots associated with this key channel.

Figure 11:
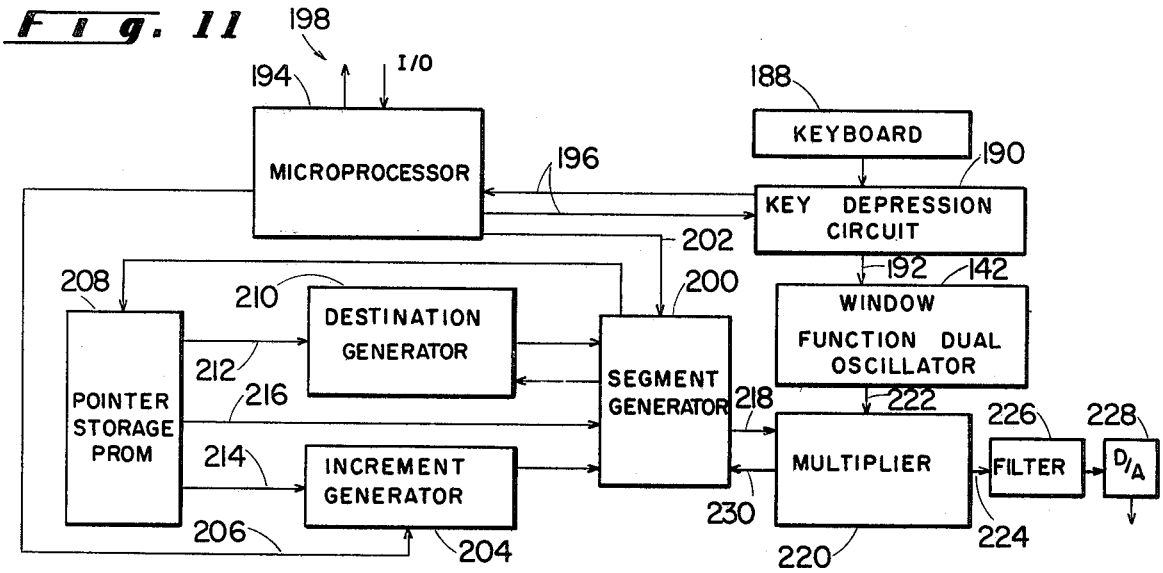
FIG. 11 is a block diagram of the musical instrument of the present invention.

Referring now to FIG. 11, an overall block diagram of the electronic musical instrument incorporating the present invention is shown. Keyboard 188 is connected to a key depression circuit 190, the latter developing on output lines 192 the multiple bit period addresses referred to in connection with the discussion of the dual phase oscillator 142 of FIG. 9. Key depression circuit 190 may include a ROM or other type of memory in which specific period addresses are read out depending upon the frequency of the key or pedal depressed. Key depression circuit 190 is connected to microprocessor 194 by lines 196 and has input-output control bus 198 for the purpose of driving the microprocessor 194 and inputting certain control functions, such as tremolo depth selection, decay length selection, and the like.

Microprocessor 194 controls segment generator 200 over lines 202, and inputs tremolo depth and decay length subtract members to increment generator 204 over lines 206.

Pointer storage PROM 208 comprises either three separate memories or a combined memory in which the destination and increment pointers as well as the next segment numbers are stored. The destination pointers are read out of pointer storage PROM 208 by destination generator 210 over lines 212, and the increment pointers are read therefrom by increment generator 204 over lines 214. Segment generator 200 reads out the next segment numbers from the next segment number section of PROM 208 over lines 216. Segment generator 200 generates a series of digital numbers on output lines 218 in time multiplex fashion that represent the amplitude values of each of the thirty-two segments for each of the eight envelopes pertaining to the waveforms in the series 94 for each of the sixteen key channels. These digital numbers are connected to multiplier 220, which scales the window function waveforms connected to it over lines 222 by the amplitude values to produce on output lines 224 a series of scaled digital amplitude values. These values are voice filtered in digital filter 226, and converted to analog values by digital-to-analog convertor 228. Segment generator 200 also receives accumulator values from multiplier 220 over lines 230.

A segment is part of the steady state regime if its segment number lies between 8 and 23 and, unless certain tremolo constraints are applied, the segment generator 200 will continue to function in the normal manner, that is, the accumulator therein will total increments until the current destination is reached, then the next segment number for this completed segment will be read out of pointer storage PROM 208 to access the new increment and destination pointers from memory 208 for the next segment. When segment 23 is reached, the next segment number for it will be some previous segment in the sustain portion so that a loop of segments will be established at this point. In other words, once segment 23 is reached, its next segment may be segment 10 so that the entire sustain portion will be continued until segment 23 is again reached, at which time the entire cycle will be again repeated as long as the key of keyboard 188 is depressed. If desired, the previous sustain segment, which is segment 22, could be repeated alternately with segment 23. This scheme of providing separate envelopes for the eight waveforms in the series 94 enables the sustain time functions for the overall tone to vary pseudo-randomly about a steady state reference level. The steady state or sustain portion for one waveform in this series probably will not have break points that occur at times that are the same for the break points of envelopes for other waveforms in the series 94 for the same note channel. Thus, a subtle randomness can be built into the steady state evolution of a note to thereby eliminate the monotony characteristic of many electronic instruments.

If the system is equipped for tremolo, it is desirable to provide a synchronization pulse by means of a programmable counter, possibly internal to microprocessor 194, so that the microprocessor will produce the synchronization pulse twice during each cycle of tremolo variation. This synchronization line will be used to keep all currently active tremolo vibrations in synchronization with each other, at least in connection with the waveforms pertaining to a single note channel.

If tremolo is selected, then segment generator 200 will add the increments to the accumulator as before, however, a destination will not be used to terminate a tremolo segment. Instead, segment generator 200 will continue to add increments to the segment until one of the synchronization pulses is received. At this point, the next segment in the tremolo series will be initiated and increments for that segment will be added to it until another synchronization pulse is received, at which point either the next segment in the sustain portion or, if the segment generator has reached segment 23, then segment 22, will be repeated until the synchronization pulse occurs.

The tremolo depth can be modified by changing the magnitude of the increment which is added to or subtracted from the amplitude during the tremolo segments. If the signal on line 206 to increment generator 204 has the effect of increasing in size the magnitude of the increment, then that segment in the tremolo series will reach a higher or lower magnitude for positive or negative directions, respectively, by the time the next synchronization pulse occurs. This results in segments in the tremolo series with peaks that are further apart. Correspondingly, if the increment is reduced by the control signal on lines 206, then the tremolo depth will be smaller. Each segment in the sustain range from 10 to 24 will trace out a 180° half cycle of tremolo, and each segment may have an increment that is somewhat greater than the increment for the previous segment so that the tremolo depth will build up with time. The last two segments, numbers 22 and 23 together trace out a 360° tremolo cycle of full amplitude thereby causing a 100% depth modulation of the slot weight in question if the depth adjustment provided by microprocessor 194 on lines 206 is currently zero and if the synchronization pulses are coming at a maximum possible rate. The depth adjustment signal on lines 206 is a four bit binary number fed to a subtractor, as will be described in greater detail hereinafter. The nominal increments in PROM 208 are the largest possible so that the signals on lines 206 result in subtracting more or less from the increment values to adjust the tremolo depth. The last two segments 22 and 23 will continue to be repeated until the decay portion of the amplitude envelope is initiated.

Figure 10A:
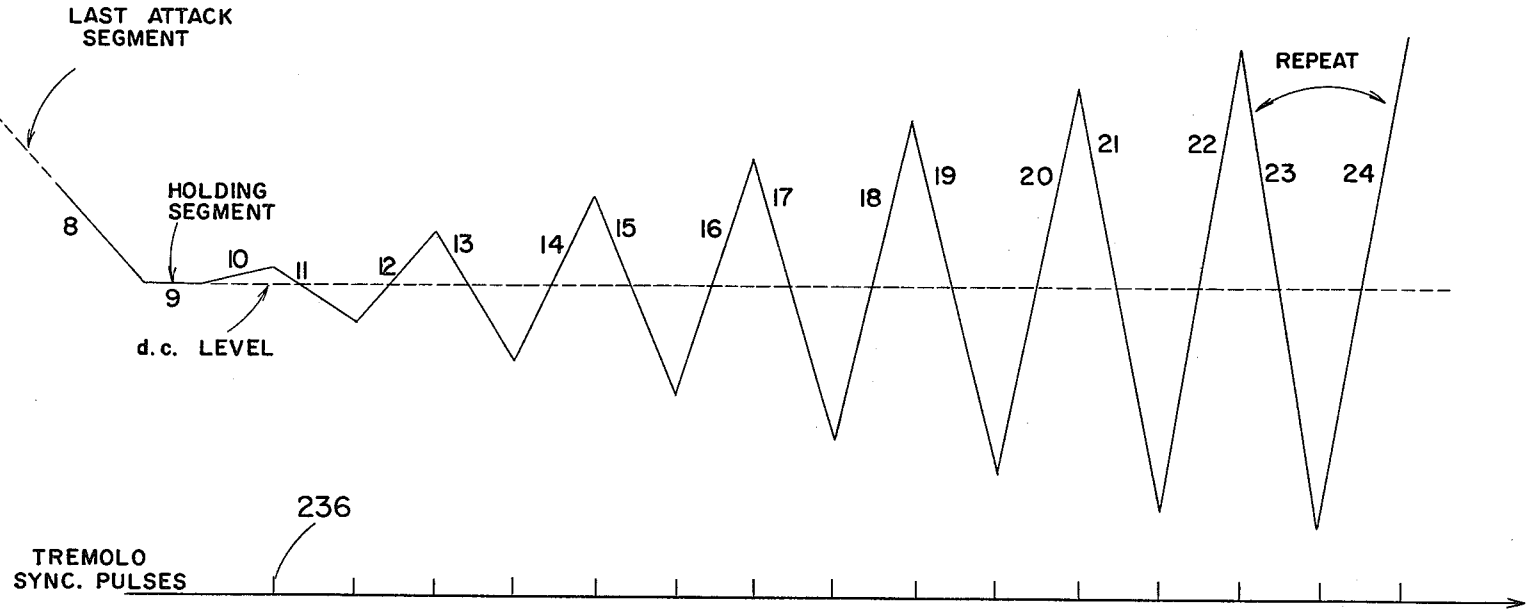
FIG. 10A is a tremolo waveform.

FIG. 10A is a plot showing the sustain portion of one of the envelopes and illustrating the manner in which tremolo depth can increase with time. Segment 8 is a holding segment not exhibiting any variation in amplitude or tremolo, and the tremolo can begin with segment 9 and continue through segment 23. It will be noted that the tremolo synchronization pulses 236 mark the change in direction of the tremolo segments, and also that segments 22 and 23 are repeated as long as the key is depressed, although the segment lengths can be changed by making the increment values larger or smaller for these segments.

The decay portion of the envelope illustrated in FIG. 10 comprises segments 24 through 31. Various tabs may be set on the control of microprocessor 194 so that various sustain lengths are imposed on the note, or we may wish to abort the decay very quickly in the event that sixteen key channels are all occupied, so that the decay will be accomplished much more quickly thereby freeing a channel for the depression of a new key. Alternatively, the sustain could be eliminated completely and the new note reattacked at the same level.

During the decay portion, after an increment is added to the accumulator the accumulator sum is compared to determine whether it is beyond the destination for this particular segment. If it is, then the accumulator is replaced with its former value, not the destination, and an advance to the next segment number will be made as usual. Thus, if the segment generator 200 enters the decay portion of the envelope at a level that is below the intended range of segment number 25, it will hold steady at its old value for one slot weighting update time interval, and then the compare step will again be performed using the increment for segment 26. Again, if the sum of the accumulator and the new increment exceeds the destination for segment number 26, the accumulator will continue to hold steady for yet another update time interval, after which segment number 27 will be tried. At some point, the decay segment tried will be lower than the present level of the accumulator, and then the remaining decay segments will be traced out in a normal manner. This situation may occur in the case where very large tremolo swings are present when the key is released, so that the system is forced into the decay mode at an amplitude below the start of segment 25 for that particular waveform in the series.

To achieve decays that are longer or shorter in duration, microprocessor 194 provides a subtract value on lines 206 to increment generator 204 that makes the necessary adjustment in the increment length to change the slope of the decay segments. The number which appears on inputs 206 will either be a zero, positive or negative number to be subtracted from all of the increment pointers used in the decay portion so that the slope can be either increased or decreased from its nominal value.

Figure 12:
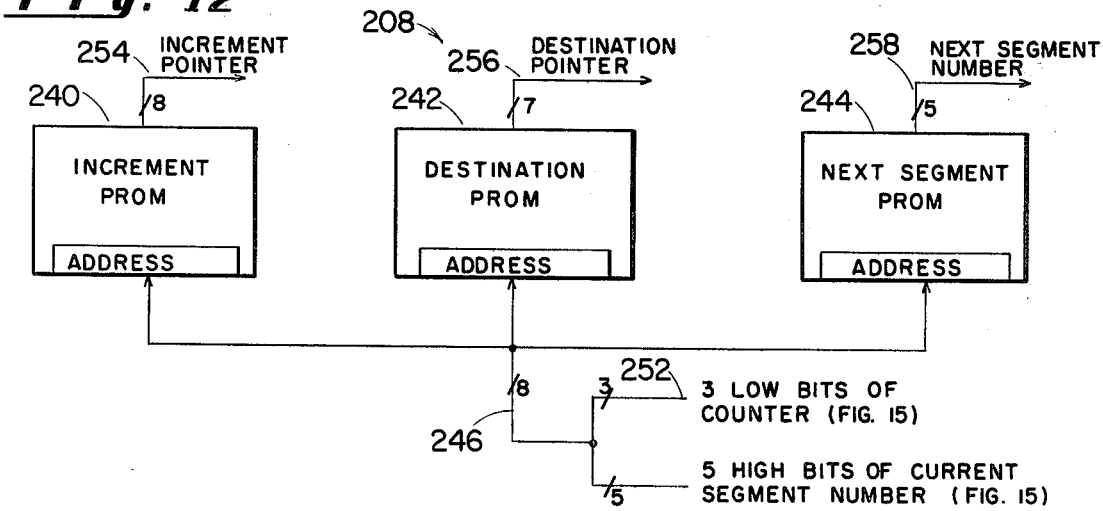
FIG. 12 is a block diagram of the pointer and next segment generation system.

FIG. 12 illustrates the three programmable read only memories making up the memory 208 shown in FIG. 11. The increment pointer values are stored in increment PROM 240, the destination pointer values are stored in PROM 242, and the next segment numbers are stored in PROM 244. PROMs 240, 242 and 244 are addressed by an eight bit word on lines 246, which comprises the five high bits of the current segment number from random access memory 248 in segment generator 200 (FIG. 15), and the three low bits of counter 250 in segment generator 200 (FIG. 15), which generates the timing signals for the entire system. The three low bits of counter 250 on lines 252 define the eight possible states for the eight waveforms in each series 94. The increment pointer values are output from PROM 240 on eight bit bus 254 and connected to increment generator 204 (FIG. 14), the seven bit destination pointers on output 256 are connected to destination generator 242 (FIG. 13), and the five bit next segment number on output 258 of PROM 244 is connected to segment generator 200 (FIG. 15).

Figure 14:
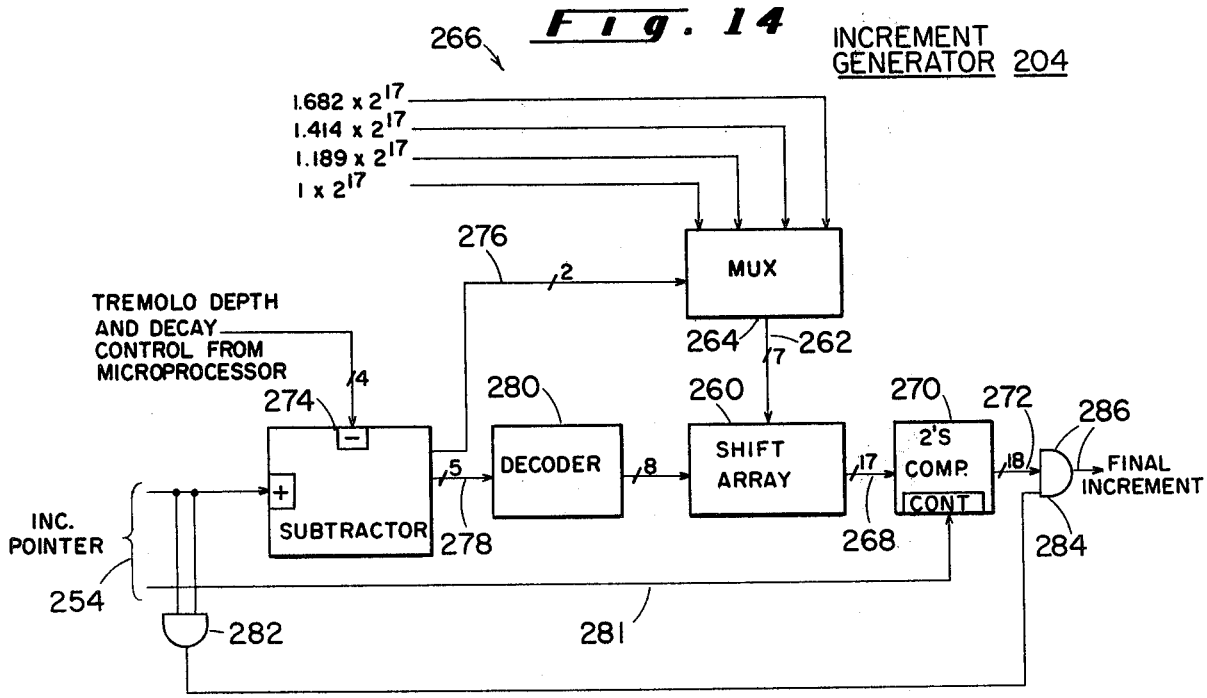
FIG. 14 a schematic of the increment generation circuit.
Figure 15:
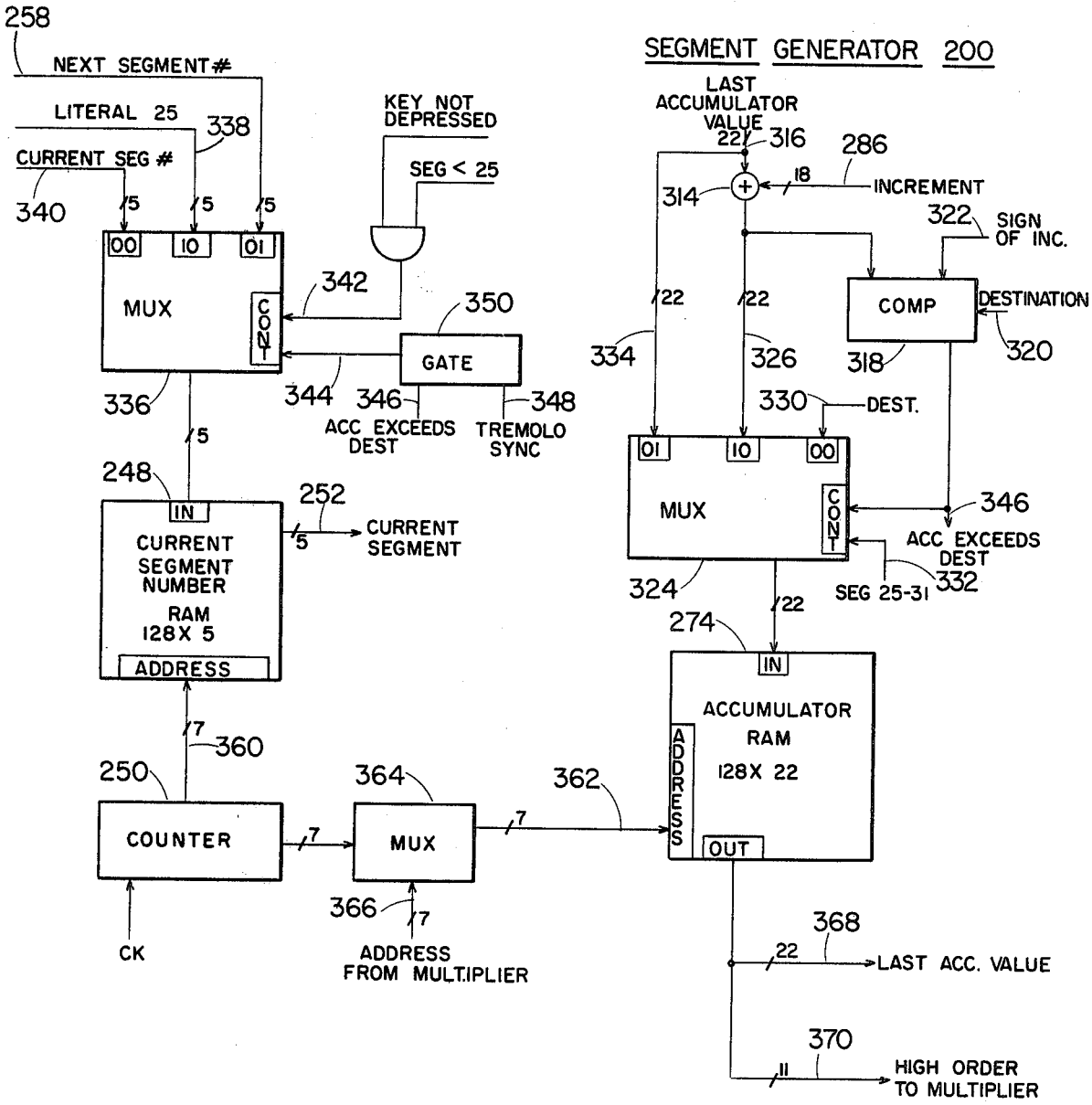
FIG. 15 is a schematic of the segment generation circuit.

Referring now to FIG. 14, the increment generator 204 will be described. Assume that eighteen octaves of 6 dB each are needed with four values in each octave having the following relationship:

$$2^0=1$$

$$2^{1/4}=1.189$$

$$2^{1/2}=1.414$$

$$2^{3/4}=1.682$$

The fact that the values of one octave differ from those of another by only a power of two factor, which is one bit shift, a simple shift array 260 can be used to move from one bank of four values to another. Seven magnitude bits on lines 262 are input to the shift array from multiplexer 264, which has the four values indicated connected thereto over outputs 266. Seventeen bits leave shift array 260 over lines 268 and are connected to the input of 2's complement circuit 270 thereby causing eighteen unsigned bits on its output 272. These are complemented if necessary to accomodate negative increments. The output is then ready to add to the accumulator 274 in segment generator 200 (FIG. 15).

The eight bit pointer words on lines 254, seven of which are connected to subtractor 274, comprise two least significant bits on lines 276 to select one of the four inputs of multiplexer 264. The next five bits on lines 278 drive a 1 of 18 decoder to select one of the 6 dB octaves, and the most significant bit on line 281 is sign bit which selectively activates 2's complement circuit 270 to provide a 2's complement value for the output of shift array 260 in the event that a negative increment is needed. Shift array 260 may be a 4 by 4 barrel shifter commonly used in MOS integrated circuitry.

In order to provide for an increment of zero value, which will occasionally be needed, it is proposed that pointer 01100000 refer to the zero increment. In order to determine whether a zero increment is called for, it is only necessary to check the two 1 bits since no other pointer for an increment can have both of these bits at the logic one level. A simple decoding gate 282 can detect a zero increment value so as to disable gate 284 to provide a zero level output on lines 286. Lines 286 are connected to segment generator 200 (FIG. 15).

The increment pointer values which will be used are illustrated by the following:

| | SIGN | OCTAVE SELECT | FRACTIONAL POWER OF 2 |
|---|---|---|---|
| SHIFT RIGHT | 0 | 10001 | 11 |
| 17 BITS | . | . | . POSITIVE |
| | . | . | . INCREMENTS |
| NO SHIFT | 0 | 00000 | 00 |
| SHIFT RIGHT | 1 | 10001 | 11 |
| 17 BITS | . | . | . NEGATIVE |
| | . | . | . INCREMENTS |
| | . | . | . |
| NO SHIFT | 1 | 00000 | 00 |

As discussed earlier, there are two basic situations in which there may be a desire to deviate from the normal increment values listed in the increment PROM 240. If the system is currently in the sustain portion of the envelope, and if this voice is capable of tremolo, then a tremolo depth adjustment may be made by microprocessor 194. Moreover, if the note channel is in the decay portion then its decay length may require lengthening, shortening or an extremely fast decay in order to accomplish a note channel abort. Subtractor 274 simply subtracts the proper positive, negative or zero value from the increment pointer on input 254 depending on the four bit control word on lines 206.

Figure 13:
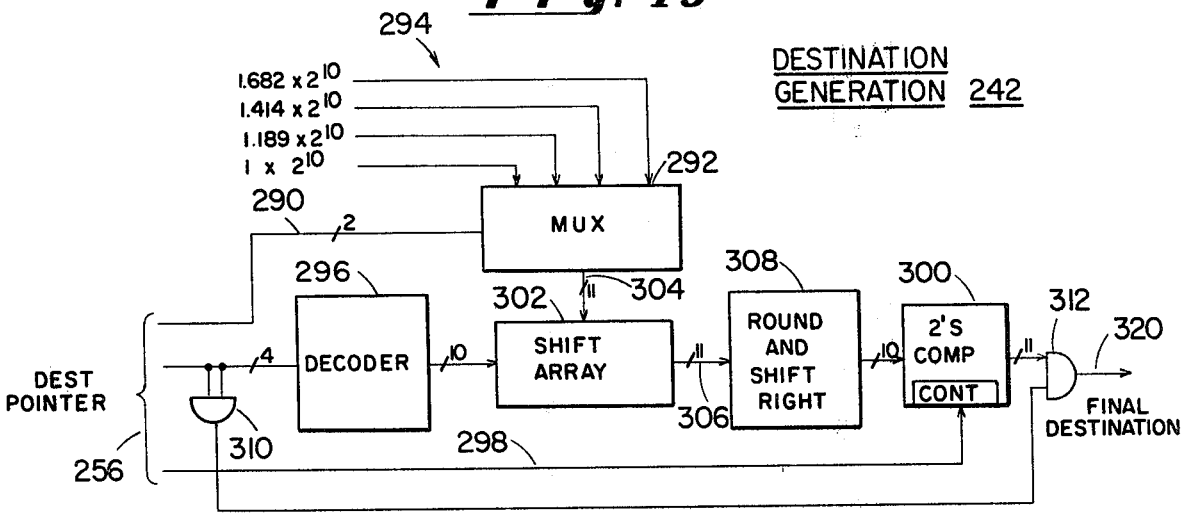
FIG. 13 is a schematic of the destination generation circuit.

FIG. 13 shows the destination generator 242 which is very similar to increment generator 204 (FIG. 14). The destination pointer values on inputs 256 are seven bits wide, with two bits on lines 290 controlling multiplexer 292 to select one of its inputs 294, which are in the same general format as the inputs to multiplexer 264 for increment generator 204. Four of the bits drive one-of-ten decoder 296, and the last bit on line 298, which is a sign bit, controls 2's complement circuit 300. A very similar shift array 302 receives the eleven bit output 304 from multiplexer 292, and its eleven bit output 306 is connected to round and shift right circuit 308, the output of which is connected to 2's complement circuit 300.

The eleven bit destination values on the input 304 of shift array 302 are also exponentially spaced so that a skip of four successive destination values will result in a factor of two change in the destination. Thus, a step of one yields approximately a 1½dB change. Not counting the special zero destination level, there will be forty destination levels available according to the following chart:

| Pointer | Approx. Destination Value (in LSB) | dB Level |
|---|---|---|
| 0000000 | 1 | 0 dB |
| 0000001 | 1.189 | 1½ dB |
| 0000010 | 1.414 | 3 dB |
| 0000011 | 1.682 | 4½ dB |
| 0000100 | 1 × 2 | 6 dB |
| 0000101 | (1.189) × 2 | 7½ dB |
| 0000110 | (1.414) × 2 | 9 dB |
| 0000111 | (1.682) × 2 | 10½ dB |
| 0001000 | 1 × 4 | 12 dB |
| . | . | . |
| . | . | . |
| . | . | . |
| 0100100 | $1 \times 2^9$ | 54 dB |
| 0100101 | $(1.89) \times 2^9$ | 55½ dB |

-continued

| Pointer | Approx. Destination Value (in LSB) | dB Level |
|---|---|---|
| 0100110 | $(1.414) \times 2^9$ | 57 dB |
| 0100111 | $(1.682) \times 2^9$ | 58½ dB |

Again, the special pointer for a destination of zero will be 0110000 so that only the two 1 bits need be detected by gate decoder 310 to disable gate 312 (FIG. 13). Negative destinations will have the same pointer codes except that the most significant bit will be 1. Reiterating, the two low order bits of the destination pointer on lines 290 select one of the four unscaled destination values within a single octave, the next four bits determine the amount by which this unscaled value is to be shifted to produce its proper size, and the most significant bit on line 298 is the sign bit.

FIG. 15 illustrates the segment generator 200. It comprises an adder 314 to which is connected the 22 bit last accumulator value on line 316 from accumulator RAM 274, and also the eighteen bit increment value on line 286 from gate 284 (FIG. 14). The accumulator value is the actual amplitude value expressed in twenty-two bits of data, and is the algebraic sum of the eleven bit destination values from destination generator 242 and the eighteen bit increment values from increment generator 204. Accumulator RAM 274 is 128 by 22 because it must be capable of storing the current accumulator values for all eight waveforms in each series 94 for the sixteen channel time shared system.

Comparator 318 compares the output of adder 314 with the destination value on line 320 to determine whether the last accmulator value exceeds the destination value or not. A sign input 322 is necessary because if the accumulator currently lies algebraically below the prescribed destination, then the accumulator may or may not "exceed" this destination depending upon the sign of the increment. If the increment is negative, then this segment is apparently complete; however, if the increment is positive, then further contributions of the increment to the accumulator must be made before this segment can be terminated. If the accumulator value exceeds the destination, then input 326 to multiplexer 324 is selected thereby and connected to the input of accumulator RAM 274. This value will be the previous accumulator value incremented by one increment, and the cycle then repeats itself. If the accumulator value exceeds the destination, then the destination input 330 for that segment is selected. If the segment generator for that particular waveform is in the decay portion as indicated by the input on lines 332, and if the accumulator value is below the destination for that particular decay segment, which would indicate that the key has been released at a time when the amplitude is below the amplitude of the beginning of the decay, then the last accumulator value on input 334 is selected, and this continues until the appropriate decay segment for that amplitude level is reached so that decay can continue. The operation of this was described earlier.

Multiplexer 336 selects the next segment number input 258 or a "literal 14" input 338 in order to initiate the decay portion of the envelope, or the current segment input 340, depending on the inputs 342 and 344 to multiplexer 336. If a key is not depressed and the segment number is less than 24 thereby indicating that the system is not already in the decay mode, then the literal 24 input 338 is selected and stored in current segment number RAM 248. This will cause the system to go into the decay mode at that point, which is necessary if a key is released either during the attack or sustain portions. If a key continues to be held and the accumulator value exceeds the destination thereby causing an output on line 346 from comparator 314, multiplexer 336 will select the next segment number input 258, because the prior segment has apparently reached its destination. Also, if the system is in the tremolo mode and a tremolo pulse appears on the input 348 of gate 350, this will toggle multiplexer 336 to select the next segment number as was described earlier. If the system is in the tremolo mode and no tremolo sync pulse is present on the input 348 of gate 350, however, multiplexer 336 will be caused to select the current segment number 340 until such sync pulse occurs.

Figure 16:
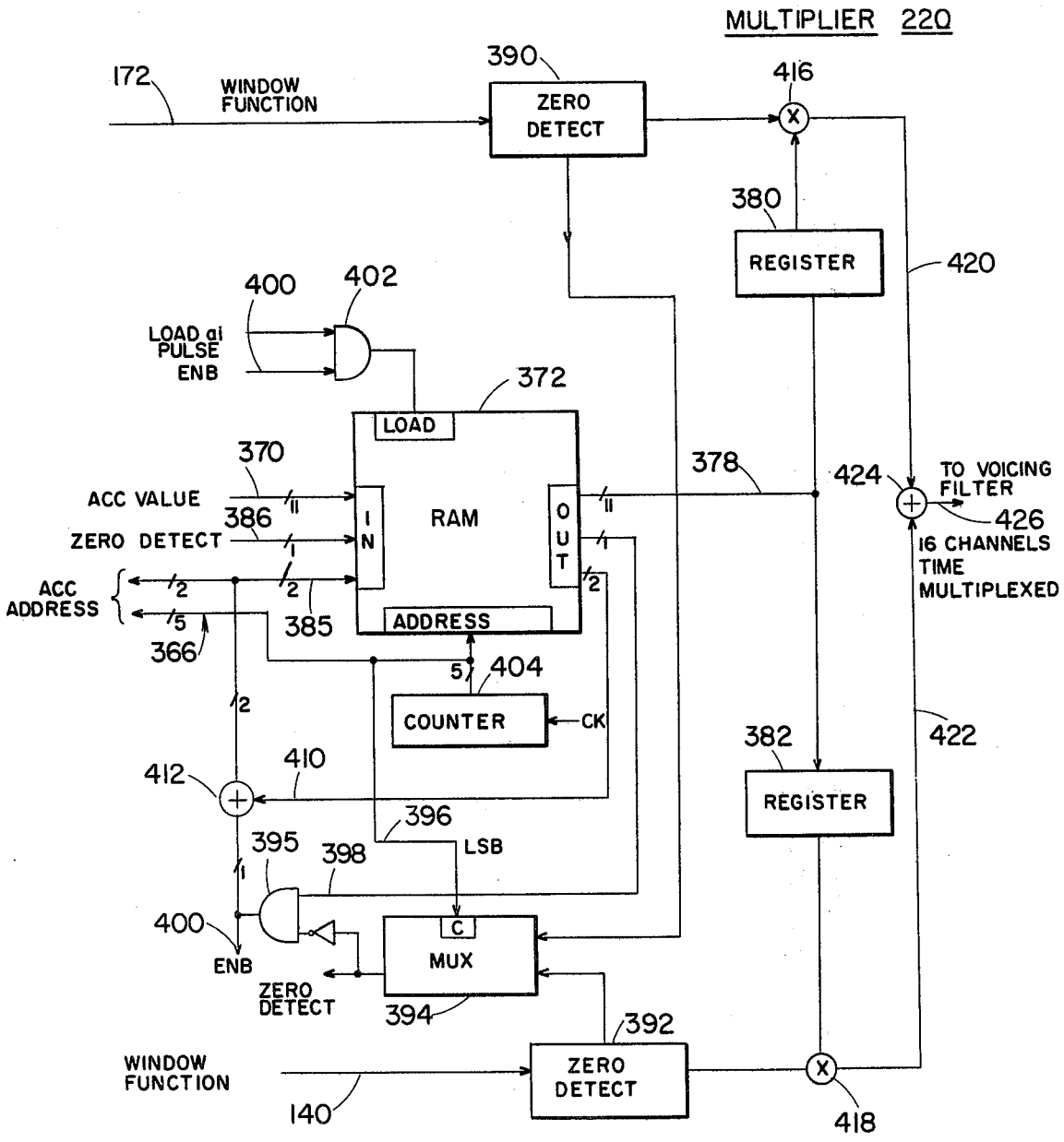
FIG. 16 is a schematic of the multiplier.

As was described earlier, the current segment number output 252 from RAM 248 forms a portion of the address for the increment, destination and next segment memories 240, 242 and 244 in FIG. 12. Current segment number RAM 248 is addressed by the seven bit output 360 of counter 250, and this counter 250 also provides the address for accumulator RAM 274 over line 362 depending upon the state of multiplexer 364. Multiplexer 364 can also permit accumulator RAM 274 to be addressed by the seven bit signal on line 366 from multiplier 220 (FIG. 16). With such dual addressing, the multiplier circuit may also have access to the eleven high order bits of the current accumulator values.

The output 368 from accumulator RAM 274 carries the twenty-two bit amplitude value, which is connected to the input 316 of adder 314 in order to be incremented during the segment generation process. The eleven high order bits of this twenty-two bit term are connected over lines 370 to random access memory 372 in multiplier 220 (FIG. 16). Although twenty-two bits are utilized to perform the segment generation process in FIG. 15, from a mathematical standpoint, only the eleven highest bits need be used in the multiplier circuit in order to perform the proper keying of the waveforms, because the lower order bits have very little audible effect on the amplitude levels.

FIG. 16 illustrates the multiplier circuit comprising RAM 372 in which the eleven bit accumulative values on lines 370 are stored and then output over lines 378 to registers 380 and 382 for each of the thirty-two segments. It is in this circuit that the basic waveforms on lines 172 and 140 from dual phase oscillator 142 (FIG. 9) are weighted by their appropriate time slot multipliers from accumulator RAM 274 (FIG. 15). Also stored in the RAM 372 are the two high order bits of the waveform 22 in the series 94 (FIG. 3) with which the current multiplier coefficient is associated. The least significant bit of the three bit ai number is known as a consequence of the fact that the eight time slots or waveforms of the sixteen foot voice are split into two oscillator lines. This two bit input appears on lines 385, and the zero detect input appears on line 386 to indicate the state of the last zero sample detection circuit output.

There is one such zero detect circuit 390 in oscillator line 172 and 392 in oscillator line 140, and if one of these circuits 390 or 392 detects a zero sample and if the previous sample within this same key channel was not zero, then the eleven high order bits of the accumulator for this time slot will be loaded into memory 372. Otherwise, the memory contents will remain unchanged. Thus, an updating of the time slot weight can never occur in the middle of a window function pulse, which would distort the sound. Multiplexer 394 connects the outputs of zero detect circuits 390 and 392 to gate 395 under the control of the least significant bit of the address on line 396, and the previous zero detect state on line 398 is also connected to gate 395. Gate 395 produces an enable signal on its output 400 to enable gate 402 thereby enabling the loading of the next accumulator value if a zero signal level is present. Counter 404 addresses RAM 372 and also provides a portion of the address for accumulator RAM 274 of FIG. 15, depending on the state of multiplexer 364. The two high order bits from RAM 372 on lines 410 are incremented by one adder 412 if the output of gate 395 is at a logic 1.

The eleven bit amplitude value on line 378 is stored in registers 380 and 382 and multiplied against the window function waveforms on lines 172 and 140 and multipliers 416 and 418 to produce on lines 420 and 422 two four foot periodic signals comprising slot weighted window functions wherein each window function waveform has its own envelope. These outputs 420 and 422 are summed by adder 424 to produce on output 426 sixteen channels of time multiplexed digital values representing the amplitude levels for the eight waveforms 22 in the series 94. These values will be filtered, demultiplexed and converted to analog form for the production of the musical tones selected by the keyboard 188.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic musical instrument comprising:

player operated tone selection means including a keyboard with playing keys for selecting a tone to be played by the instrument, a tone generator responsive to said tone selection means comprising a first memory in which one cycle of a waveform is stored and means repetitively for reading the stored waveform out of the memory at fixed rate regardless of which key of the keyboard is actuated but selectively adjusting the period of time between successive readings depending upon the frequency of the tone selected to thereby produce a cyclically recurring series, each series comprising a limited number of said waveforms, means for generating a time varying amplitude envelope for the waveforms having generally an attack portion, a sustain portion, and a decay portion in response to the actuation and subsequent release of a key of the keyboard, harmonic content control means for reading a second memory and adjusting the amplitude levels of the waveforms in the series independently of each other and varying with time the amplitudes of at least some of the waveforms in the series relative to others of the waveforms therein for different portions of the amplitude envelope based on data read out of the second memory to thereby produce a wavetrain of time varying harmonic content.

2. The musical instrument of claim 1 wherein the waveform stored in said first memory is the four-term Blackman-Harris window function.

3. The musical instrument of claim 1 wherein there are x said waveforms in said series and each amplitude envelope has x time shared components assigned, respectively, to said waveforms in the series, and said harmonic content control means scales the amplitudes of said waveforms in the series by the envelope components assigned to the respective waveforms.

4. The musical instrument of claim 3 wherein the value of x is 8.

5. The musical instrument of claim 3 wherein said components are each piecewise linear envelopes comprising a plurality of connected segments wherein each segment is linear, and each segment has a final destination amplitude level read out of said second memory by said harmonic content control means and an increment value which determines the slope of that segment and which is also read out of said second memory by said harmonic content control means.

6. An electronic musical instrument comprising:

player operated tone selection means including a keyboard with playing keys for selecting a tone to be played by the instrument, a tone generator responsive to said tone selection means comprising a memory in which one cycle of a waveform is stored, means repetitively for reading the stored waveform out of the memory and at a fixed rate wherein the period of time between successive readings is selectively adjusted depending upon the frequency selected by the tone selection means to thereby produce a train of said waveforms comprising a plurality of cyclically recurring series, each series having a predetermined number of said waveforms therein, an envelope generator responsive to the actuation of the key of a keyboard for generating a plurality of time varying piecewise linear amplitude envelopes each comprising a plurality of interconnected linear segments with each segment having a destination amplitude and a constant slope between its destination amplitude and the destination amplitude of the previous segment of that envelope and each including attack, sustain and decay portions each comprising diverse ones of said segments, said segments being assigned, respectively, to the waveforms in said series, and keying means responsive to the waveform train and to the piecewise linear envelopes for scaling each waveform by the envelope assigned to it thereby to enable selective varying of the amplitudes of the individual waveforms in the series independently of each other from segment to segment of the piecewise linear envelope assigned thereto so as to vary with the time the harmonic content of the waveform train.

7. The musical instrument of claim 6 wherein the waveform stored in said memory is the four-term Blackman-Harris window function.

8. The musical instrument of claim 6 wherein there are x said waveforms in said series and x time shared said amplitude envelopes assigned, respectively, to said waveforms in the series, and said harmonic content control means scales the amplitudes of said waveforms in the series by the envelopes assigned to the respective waveforms.

9. The musical instrument of claim 8 wherein the value of x is 8.

10. The musical instrument of claim 6 wherein said envelope generator means includes tremolo means for causing at least two segments in any envelope to be alternately repeated and wherein one of the two repeated segments has a positive slope and the other repeated segment has a negative slope.

11. The musical instrument of claim 10 including means for changing over time the length of the repeated segments to thereby change the tremolo depth.

12. The musical instrument of claim 6 wherein the keying means includes a multiplier having as one input said waveform train and as another input said envelopes, and an output connected to a digital filter and a digital-to-analog convertor.

13. The musical instrument of claim 6 wherein said keying means outputs scaled amplitude values of the waveforms in the series in time shared serial format.

14. The musical instrument of claim 6 including zero detect means responsive to said waveform train for preventing the changing of the scaled amplitude value of an individual waveform while that waveform is being read out of said memory.

15. An electronic musical instrument comprising:

player operated tone selection means including a keyboard with playing keys for selecting a tone to be played by the instrument, a tone generator responsive to said tone selection means comprising a first memory in which one cycle of the waveform is stored, means repetitively for reading the stored waveform out of the memory and at a fixed rate but wherein the period of time between successive readings is selectively adjusted depending on the frequency selected by the tone selection means to thereby produce the train of said waveforms comprising a plurality of cyclically recurring series, each series having a predetermined number of said waveforms therein, an envelope generator responsive to the actuation of the key of the keyboard for generating a plurality of time varying piecewise linear amplitude envelopes assigned, respectively, to the waveforms in the series and each comprising a plurality of connected linear segments, said envelope generator including: a second memory in which is stored a plurality of increment values and a plurality of destination values, destination generator means for reading out of said second memory a destination value for each of the segments in each envelope, increment generator means for reading out of said second memory an increment value for each of the segments in each envelope, and means for generating the respective segments in each envelope by repetitively increasing the amplitude by the increment value for a segment until the destination for that segment is reached and then increasing the amplitude of the respective envelope by the increment value for the next segment in the respective envelope until the destination for the next segment is reached and so on until said all of said plurality of envelopes have been generated, and keying means for scaling the amplitude of each waveform in the series by its assigned envelope.

16. The musical instrument of claim 15 wherein the waveform stored in said first memory is the four-term Blackman-Harris window function.

17. The musical instrument of claim 15 wherein there are x said waveforms in said series and each x time shared said amplitude envelopes assigned, respectively, to said waveforms in the series, and said harmonic content control means scales the amplitudes of said waveforms in the series by the envelopes assigned to the respective waveforms.

18. The musical instrument of claim 17 wherein the value of x is 8.

19. The musical instrument of claim 15 wherein said envelope generator means includes tremolo means for causing at least two segments in any said envelope to be alternately repeated and wherein one of the two repeated segments has a positive slope and the other repeated segment has a negative slope.

20. The musical instrument of claim 19 wherein said tremolo means includes means selectively for changing the magnitudes of the increment values and the destinations of the repeated segments so as to change the tremolo depth.

21. The musical instrument of claim 20 wherein said means for changing comprises: a subtractor means interposed between said second memory and said means for generating segments and a microprocessor means for inputting a selected increment pointer adjustment factor into said subtractor means, said subtractor means subtracting the increment pointer adjustment factor from increment pointers read out of said second memory to produce adjusted increment pointers which are transmitted to said means for generating segments.

22. The musical instrument of claim 21 wherein said microprocessor means varies the increment pointer adjustment factor as a function of time.

23. The musical instrument of claim 15 wherein each of said envelopes comprises an attack portion, a sustain portion, and a decay portion each comprising predetermined ones of said segments, and wherein said envelope generator means includes tremolo means for causing at least two adjacent segments in the sustain portion of any of said envelopes to be alternately repeated, and wherein one of the alternated segments has a positive slope and the other repeated segment has a negative slope.

24. The musical instrument of claim 15 wherein each of said envelopes comprises an attack portion, a sustain portion, and a decay portion each comprising predetermined ones of said segments, and wherein said envelope generator means includes decay adjustment means for selectively changing the magnitudes of the increment values assigned to at least some of the decay segments in said envelopes.

25. The musical instrument of claim 24 wherein said decay adjustment means comprises: a subtractor means interposed between said second memory and said means for generating segments, and a microprocessor means for inputting a selected increment pointer adjustment factor into said subtractor means, said subtractor means subtracting the increment pointer adjustment factor from the increment pointers read out of said second memory to produce adjusted increment pointers which are transmitted to said means for generating segments.

26. The musical instrument of claim 15 wherein: said second memory comprises a destination pointer memory, an increment pointer memory, a destination shift array circuit, and an increment shift array circuit; said destination generator means includes means for reading destination pointers out of said destination pointer memory and driving said destination shift array circuit thereby to generate said destination values; and said increment generator means for reading increment pointers out of said increment pointer memory and driving said increment shift array circuit thereby to generate said increment values.

27. The musical instrument of claim 20 wherein said destination shift array circuit and said increment shift array circuit each includes a 2's complement generator.

28. The musical instrument of claim 26 wherein said means for generating segments comprises: an accumulator RAM for storing the current amplitude of each said envelope, a current segment ram for storing the number of the current segment for each envelope, and comparison means for comparing the current amplitude of each envelope to the destination value for the current segment thereof and adding an increment value to the current amplitude of the respective envelope if the respective current amplitude does not equal or exceed the destination, and for substituting a new destination for the respective envelope when the current amplitude is exceeded by the destination value.

29. An electronic musical instrument comprising:

player operated tone selection means including a keyboard with playing keys for selecting a tone to be played by the instrument, a tone generator responsive to said tone selection means comprising a memory in which one cycle of a waveform is stored, means repetitively for reading the stored waveform out of the memory and at a fixed rate and wherein the period of time between successive readings is selectively adjusted depending upon the frequencies selected by the tone selection means to thereby produce a train of said waveforms comprising a plurality of cyclically recurring series, each series having a predetermined number of said waveforms therein, an envelope generator responsive to the actuation of a key of the keyboard for generating a plurality of time varying amplitude envelopes assigned, respectively, to the waveforms in the series, and keying means for scaling the amplitude of each waveform in the series by its assigned envelope.

30. The musical instrument of claim 29 wherein the waveform stored in said first memory is the four-term Blackman-Harris window function.

31. The musical instrument of claim 29 wherein there are x said waveforms in said series and x time shared said amplitude envelopes assigned, respectively, to said waveforms in the series, and said harmonic content control means scales the amplitudes of said waveforms in the series by the envelopes assigned to the respective waveforms.

32. The musical instrument of claim 31 wherein the value of x is 8.

33. The musical instrument of claim 29 wherein the keying means includes a multiplier having as one input said waveform train and as another input said envelopes, and an output connected to a digital filter and a digital-to-analog convertor.

34. The musical instrument of claim 29 wherein said keying means outputs scaled amplitude values of the waveforms in the series in time shared serial format.

35. The musical instrument of claim 29 including zero detect means responsive to said waveform train for preventing the changing of the scaled amplitude value of an individual waveform while that waveform is being read out of said memory.

36. A method of generating a musical tone comprising:

providing a memory in which a representation of one cycle of the waveform is stored, addressing the memory to read out the stored representation of the waveform always at a fixed rate and repetitively but selectively adjusting the period of time between successive readings to adjust the frequency desired so as to produce a series of a predetermined number of the read out waveforms, the series being cyclically repeated and wherein the waveforms are separated from each other by said period of time, generating a time varying amplitude envelope having generally an attack portion, a sustain portion, and a decay portion, keying the cyclically repeated series of waveforms with the amplitude envelope, and varying independently of each other the amplitudes of the waveforms in a series while the amplitude envelope is being generated wherein the relative amplitude levels of at least some of the individual waveforms with respect to each other change for different portions of the envelope.

37. The method of claim 36 wherein the amplitude envelope comprises a plurality of components assigned, respectively to the waveforms in the series, and the amplitudes of the waveforms in the series are varied with respect to each other by generating the amplitude components independently of each other.

38. The method of claim 37 wherein there are eight waveforms in the series and eight amplitude envelope components assigned, respectively, to the waveform.

39. The method of claim 36 wherein the waveform is the four-term Blackman-Harris window function.

40. A method of generating a musical tone comprising:

providing a first memory in which a representation of one cycle of the waveform is stored, addressing the memory to read out the stored representation of the waveform always at a fixed rate and repetitively but selectively adjusting the period of time between successive readings to adjust the frequency desired so as to produce a series of a predetermined number of the read out waveforms, the series being cyclically repeated and wherein the waveforms are separated from each other by said period of time, generating a plurality of time varying amplitude envelopes assigned, respectively, to the waveforms in the series, each envelope having an attack portion, a sustain portion and a decay portion, and scaling the amplitude of each waveform in the series by its assigned envelope so as to vary with time the harmonic content of the tone.

41. The method of claim 40 wherein the waveform is the four-term Blackman-Harris window function.

42. The method of claim 40 wherein the amplitude envelopes are each generated as a piecewise linear function comprising a plurality of connected linear segments each having a selected slope and a selected length.

43. The method of claim 42 and alternately repeating two segments in the sustain portion of at least one of the envelopes to produce a tremolo effect, one of the repeated segments in the respective envelope having a positive slope and the other repeated segment having a negative slope.

44. The method of claim 43 including varying with time the length of the repeated segments to thereby modulate the tremolo depth.

45. The method of claim 43 wherein the repeated segments are adjacent segments in the respective envelope.

46. The method of claim 42 and selectively varying the slopes of a plurality of segments in the decay portions of at least some of the envelopes to thereby modify the decay characteristics of the tone produced by the instrument.

* * * * *